US006980065B2

(12) United States Patent
King et al.

(10) Patent No.: US 6,980,065 B2
(45) Date of Patent: Dec. 27, 2005

(54) LOW NOISE BLOCK PCB MOUNTING SYSTEM USING NON-LINEAR INSERTABLE PROBES

(76) Inventors: Gerard King, Edgelee House, Upper Bucklebury, nr Reading RG7 60J (GB); Andrew Patrick Baird, 23 Strawberry Fields, Bramley, Hampshire RG26 5QF (GB)

( * ) Notice: Subject to any disclaimer, the term of this patent is extended or adjusted under 35 U.S.C. 154(b) by 0 days.

(21) Appl. No.: 10/311,609

(22) PCT Filed: Jun. 19, 2001

(86) PCT No.: PCT/GB01/02708

§ 371 (c)(1),
(2), (4) Date: May 22, 2003

(87) PCT Pub. No.: WO01/99227

PCT Pub. Date: Dec. 27, 2001

(65) Prior Publication Data

US 2003/0179147 A1 Sep. 25, 2003

(30) Foreign Application Priority Data

Jun. 22, 2000 (GB) ..... 0015153

(51) Int. Cl.[7] ..... H01P 5/103
(52) U.S. Cl. ..... 333/26; 333/21 A; 333/137

(58) Field of Search ..... 333/21 A, 26, 333/125, 135, 137

(56) References Cited

U.S. PATENT DOCUMENTS 4,126,835 A * 11/1978 Gould ..... 333/21 A
5,245,353 A * 9/1993 Gould ..... 343/786
6,211,750 B1 * 4/2001 Gould ..... 333/21 A

FOREIGN PATENT DOCUMENTS

JP 135804 * 5/1990 ..... 333/26

* cited by examiner

*Primary Examiner*—Benny Lee
(74) *Attorney, Agent, or Firm*—Darby & Darby

(57) ABSTRACT

A low nosie block (LNB) system is described which facilitates the mount of printed circuit board (PCBs) with probes attached to an LNB housing. The LNB housing has, in a preferred arrangement, two keyhole-shaped apertures located in the back wall of the waveguide for receiving the probes already mounted to the PCB. The apertures are dimensioned and proportioned to lie on either side of a waveguide septum and to allow probes, when coupled to a printed circuit board, to be inserted through the respective apertures for correct orientation within the waveguide once the printed circuit board is secured to the housing and to allow minimal transmission of electromagnetic radiation through the apertures other than by a transmission line formed by the probes.

10 Claims, 3 Drawing Sheets

LOW NOISE BLOCK PCB MOUNTING SYSTEM USING NON-LINEAR INSERTABLE PROBES

FIELD OF THE INVENTION

The present invention relates to low noise blocks (LNBs) for use in satellite communications and in particular, but not exclusively, the invention relates to a system for mounting a printed circuit board in a LNB and to a modified LNB housing for receiving a printed circuit board.

BACKGROUND OF THE INVENTION

Some LNBs are manufactured which have a waveguide at right angles to a support housing which carries a printed circuit board with circuitry for receiving electrical signals and probes which extend through the rear wall of the waveguide. Such LNBs are particularly sold in the United States and South American market.

With some probe designs, the probes are located in dielectric bushes and the probes are also not straight but are arranged so that the tips of the probe are bent, such that when the probes are located within the waveguide, the leading portion of the tip is in proximity to the septum or the waveguide wall so as to provide capacitive coupling between the probe and the waveguide. The probes effectively form a coaxial transmission line between the waveguide rear wall and the PCB by virtue of the fact that they are positioned on the centre line of a symmetrical aperture in the housing. The ends of the probe are located in the dielectric bushes and the bush/probe assembly is, in use, connected to the printed circuit board which sits on a housing at right angles to the main axis of the waveguide. Such an arrangement is disclosed in applicant's co-pending U.K. Application No. 9928095.0.

The probes are soldered to the circuit board. This means that the probe/bush assembly has to be carefully positioned and soldered to the circuit board. The circuit board is then fastened to the housing and then covered. Should there be a fault in the circuit board which requires board removal or the probe is incorrectly oriented in the waveguide, then this requires that the probe(s) be de-soldered from the board so as to allow the probes and the board to be extracted from the LNB.

In situ, this is very difficult. Even in the laboratory, the probes have to be de-soldered, the board removed and then the probes extracted from the waveguide. Assembly requires the reverse of the process which is time-consuming and inconvenient.

SUMMARY OF THE INVENTION

An object of the present invention is to provide an improved PCB mounting system for use with LNBs which obviates or mitigates at least one of the aforementioned disadvantages.

This is achieved by providing a LNB housing which has at least one aperture in the housing for receiving a probe already mounted to a printed circuit board, the aperture being dimensioned and proportioned to allow minimal transmission of electromagnetic radiation through the aperture other than by a transmission line formed by the probes.

In a preferred arrangement, two apertures are disposed in a housing which forms the back wall of the waveguide, the apertures being dimensioned and proportioned to lie on either side of a waveguide septum and to allow probes, when coupled to a printed circuit board, to be inserted through the respective apertures for correct orientation within the waveguide once the printed circuit board is secured to the housing.

Conveniently, these apertures are sufficiently large to accommodate the probe when the printed circuit board is installed to allow slight manipulation of the printed circuit board into a position when it is secured to the housing.

The apertures can be of any suitable shape to receive the probes and to accommodate probe geometry. They may be elongate, key-hole shaped, oval or rectangular as long as they form an aperture in the rear wall of the waveguide which is insufficient to allow leakage of radiation through the aperture and so that electromagnetic radiation within the waveguide is reflected from the back wall within the waveguide for detection by the probes.

According to a first aspect of the present invention, there is provided a low noise block (LNB) having an antenna feed, a waveguide coupled to the antenna feed, the waveguide having a rear wall, a housing coupled to the waveguide and arranged substantially perpendicular thereto, the waveguide rear wall forming part of the housing, the waveguide rear wall having at least one aperture therein for receiving a probe when coupled to a printed circuit board, such that the probe is oriented in the waveguide for reception of electromagnetic radiation passing therealong, said at least one aperture being dimensioned and proportioned to minimise the leakage of microwave radiation passing through the aperture other than by the probe, the printed circuit board being insertable and removable with respect to the LNB housing without decoupling the printed circuit board from the probe.

Preferably, two apertures are disposed in the rear wall of the waveguide. Conveniently, the two apertures are arranged on either side of a waveguide septum for receiving a respective probe on either side of the septum.

Preferably, the apertures are elongate and, more preferably, the apertures are keyhole-shaped and have ends which converge towards each other and towards the septum of the waveguide. Alternatively, the apertures may be rectangular, oval or circular.

According to a further aspect of the present invention, there is provided a low noise block (LNB) comprising an antenna feed, a waveguide coupled to the antenna, said waveguide having a rear waveguide wall, a housing coupled to the waveguide, wherein the rear waveguide wall forms part of the housing, and the housing being oriented substantially perpendicular to the waveguide, a printed circuit board adapted to be secured to the housing, the printed circuit board carrying two probes for insertion into the waveguide, said rear waveguide wall having two apertures disposed therein for receiving said probes when coupled to the printed circuit board, said apertures being dimensioned and proportioned to receive said probes without the probes being removed or separated from the printed circuit board for installation of the probes within the waveguide and for removal of the probes from the waveguide.

BRIEF DESCRIPTION OF THE DRAWINGS

These and other aspects of the present invention will become apparent from the following description when taken in combination with the accompanying drawings in which.

DETAILED DESCRIPTION OF THE INVENTION

Figure 1:
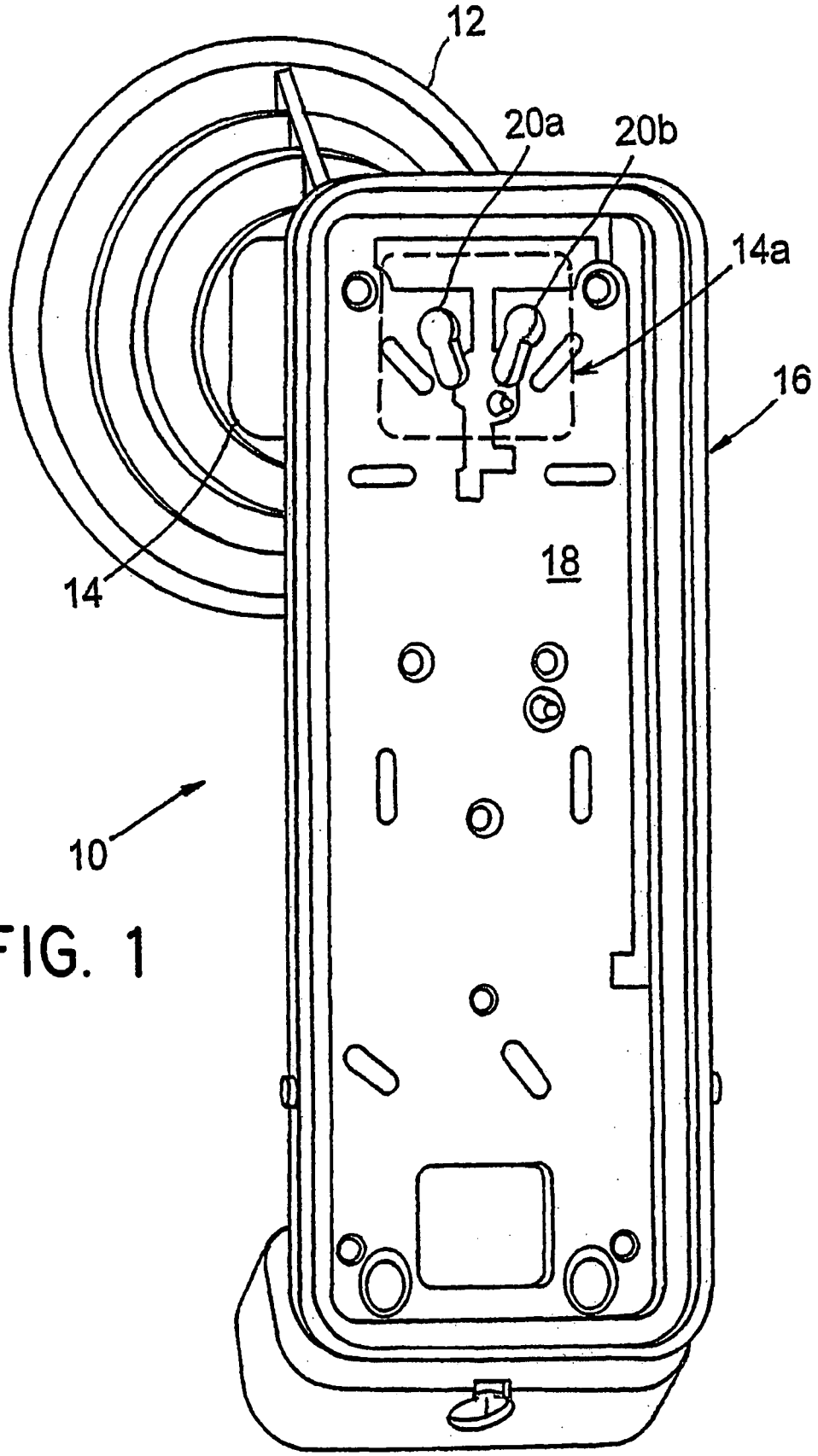
FIG. 1 is a rear view of a low noise block in accordance with a preferred embodiment of the invention with the printed circuit board and rear housing cover removed.

Reference is made to FIG. 1 of the drawings which depicts a LNB generally indicated by reference numeral 10 which consists of three principal aluminium components, a corrugated horn antenna 12, a waveguide of square cross-section 14, which is coupled to the horn antenna, and a rear printed circuit board housing, generally indicated by reference numeral 16, which is integral with the waveguide 14, which is oriented at substantially right angles to the main axis of the waveguide 14.

The waveguide 14 has a rear wall 14*a*, shown in broken outline, in FIG. 1 which is integral with the housing 16. It is well known to those of skill in the art that the rear wall of the waveguide reflects electromagnetic radiation received by the waveguide back along the waveguide for reception by waveguide probes into which electromagnetic signals are coupled for subsequent processing by the printed circuit board (not shown in the interests of clarity) and eventual transmission to a converter box (also not shown in the interests of clarity). As will be seen from FIG. 1, the rear housing 16 has a housing face 18 which is integral with the rear waveguide wall 14*a*. A printed circuit board carrying two probes is adapted to be mounted on the rear face 18, as will be later described in detail.

The rear face 18 has two keyhole-shaped apertures 20*a*, 20*b* disposed in the rear waveguide wall 14*a*. The apertures are oriented for receiving probes coupled to the printed circuit board such that when the probes are inserted into the waveguide, they are correctly aligned and positioned in relation to the septum of the waveguide.

Figure 2:
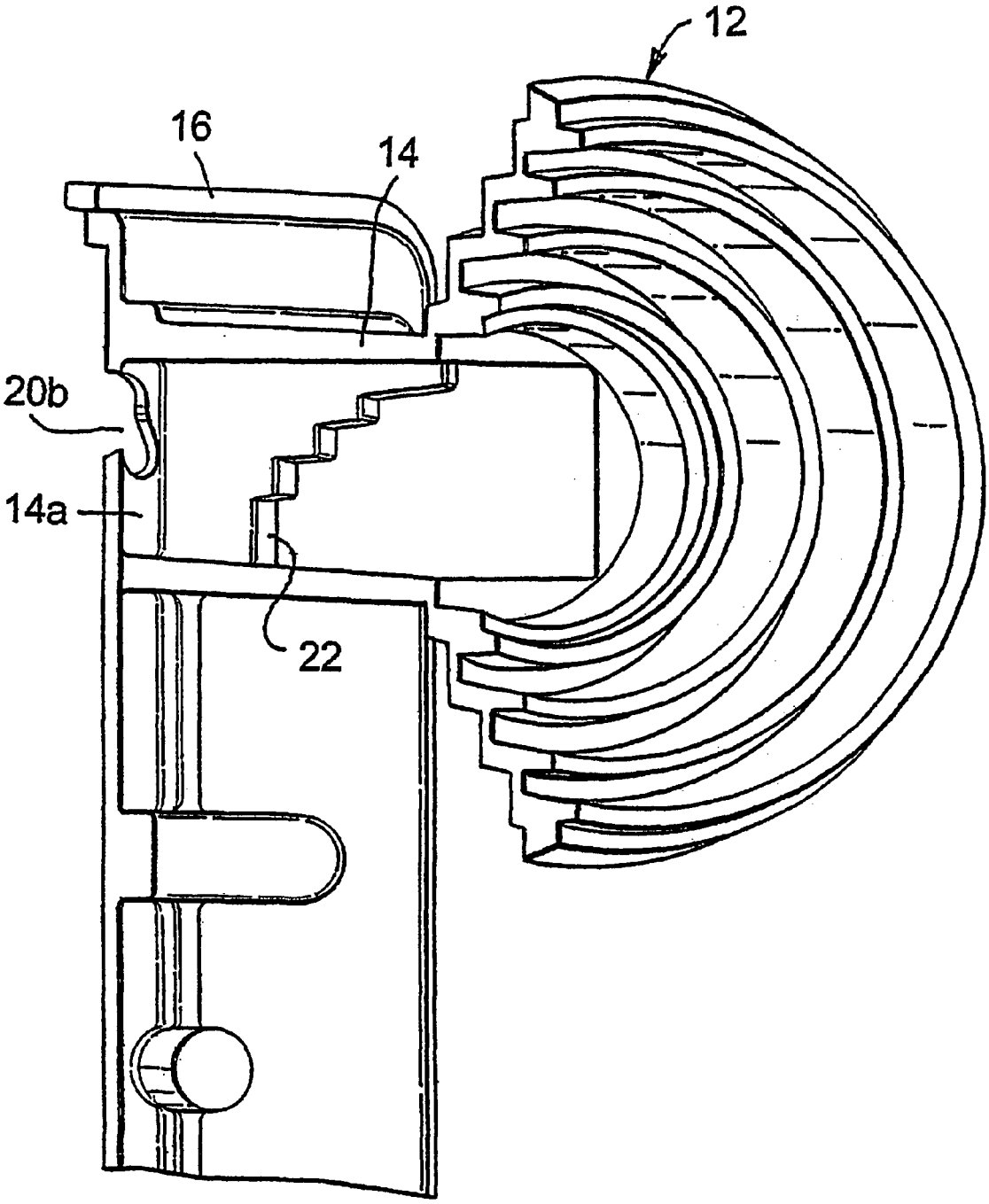
FIG. 2 is an enlarged and part-sectional view of the LNB of FIG. 1 taken from the front of the LNB.

Reference is now made to FIG. 2 of the drawings which depicts an enlarged and part-sectional view of the LNB of FIG. 1. In this view it will be seen that the rear housing 16 is partly sectioned through one of the apertures 20*b* and the part-sectioning is also applied to the waveguide 14 and corrugated feed horn 12. It will be seen therefore that the aperture 20*b* in the rear face 14*a* of the waveguide is adjacent to the stepped septum 22.

Figure 3:
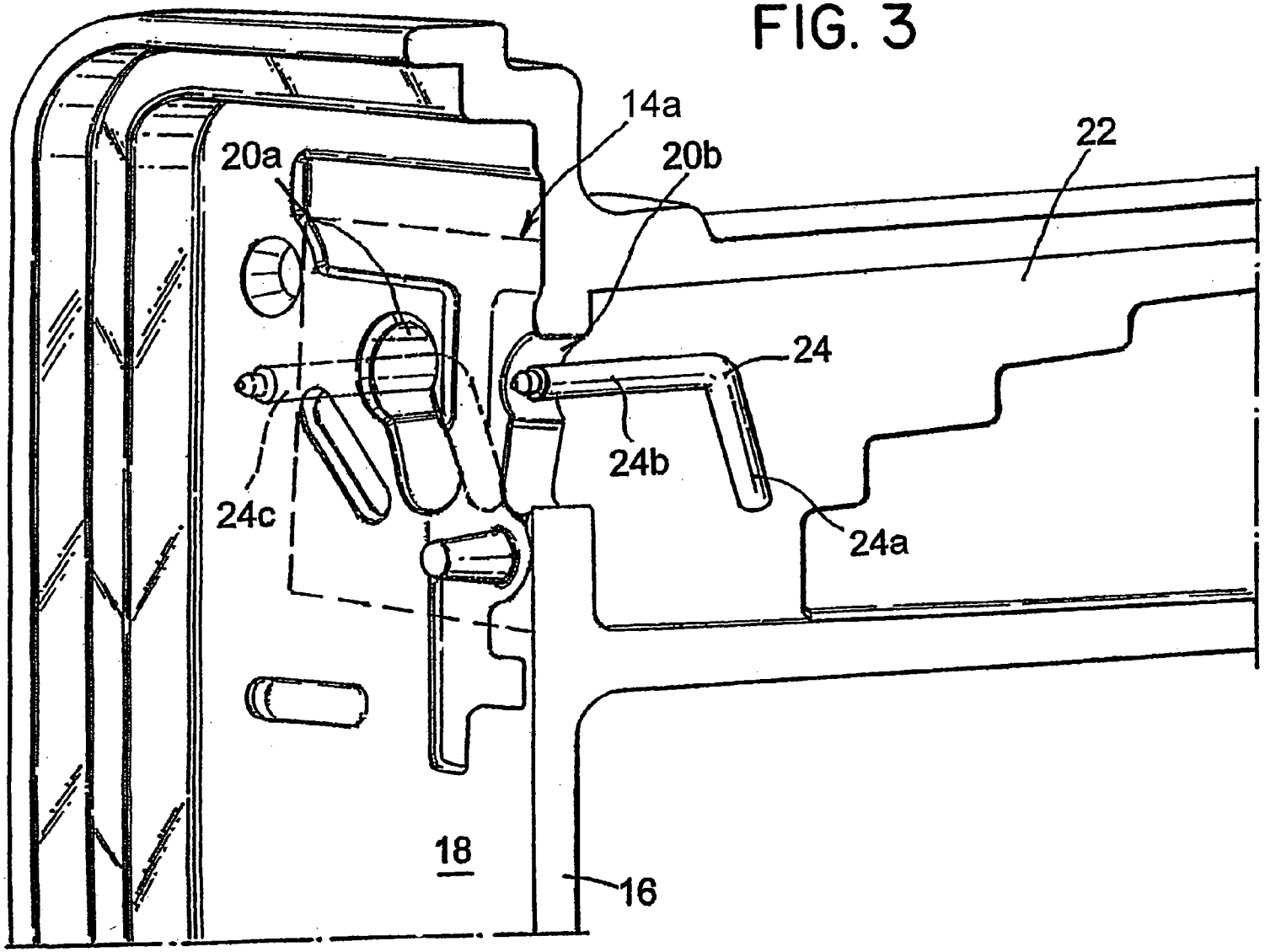
FIG. 3 is an enlarged side and rear view of the LNB of FIGS. 1 and 2 depicting the location of one probe within the waveguide after installation and location of the same probe, shown in broken outline, prior to installation of the printed circuit board in the LNB.

Reference is now made to FIG. 3 of the drawings which shows part of the LNB of FIGS. 1 and 2, drawn to an enlarged scale, with a probe shown located in situ through aperture 20*b*. It will be seen that the probe 24 is not straight; the leading end 24*a* of the probe is angled from initial end 24*b* and it will also be appreciated that end 24*a* is angled towards the septum 22. This also applies to a second probe inserted through aperture 20*a*, which is not shown in the interests of clarity. The probe end 24*b* is coupled to a printed circuit board 26, shown in broken outline. A second probe (not shown) is also coupled to the printed circuit board and is inserted through aperture 20*b*. Thus, the probes adopt the orientation shown when the printed circuit board is correctly fitted into the rear face 18 of the housing 16. The apertures 20*a*, 20*b* are shown dimensioned and proportioned to allow the probes, when coupled to the printed circuit board, to be inserted through apertures 20*a*, 20*b*, so that the probes are correctly aligned and oriented in relation to the septum 22 and the printed circuit board can be secured to the housing 16. Probe 24 is shown in broken outline (24*c*) prior to the printed circuit board being inserted into housing 16. It will be understood that these apertures allow these shaped probes to be readily inserted into the waveguide to accommodate the printed circuit board in the rear housing 16. It will also be appreciated that if for any reason the probes and/or the printed circuit board are required to be removed from the housing, then this is simply done and the printed circuit board and probes can be removed as a unit and that there is no requirement to separate the printed circuit board from the probes by desoldering the probes, as is required in the prior art.

Thus the present invention has the significant advantage that no de-soldering is required and the combined printed circuit board and probes can be readily installed and removed from the LNB.

It will be appreciated that the apertures are dimensioned and proportioned to receive the probes but also to have minimal or negligible effect on the waveguide 14. In this regard it will be appreciated that the apertures are dimensioned in proportion so that electromagnetic radiation within the waveguide is reflected from the back surface and does not pass through the apertures. This is analogous to a mesh antenna dish which operates on the same principle.

Various modifications may be made to the LNB hereinbefore described without departing from the scope of the invention. For example, it will be appreciated that the apertures need not be exactly shaped as shown in the drawings. The apertures may be oval or elongate or even circular and they may be dimensioned in proportion to accommodate various designs of probe with the requirement being that the apertures do not couple radiation from the waveguide through into the housing other than by the probe and that the reflector plate at the back of the waveguide remains unaffected by the apertures. It will also be appreciated that although two apertures are shown because two probes are required in this embodiment, a single aperture may also be used.

The waveguide may be made of any other suitable conductive material other than aluminium, such as zinc or a zinc alloy.

Thus the principal advantage of this invention is that there is no requirement to desolder probes from a printed circuit board in order to remove probes from the waveguide or even to install new probes into the waveguide and this facilitates maintenance or repair of LNBs and also of testing various orientations of probes.

A further advantage is that dielectric bushes used in previous designs for facilitating probe assembly are not required saving assembly time and cost.

What is claimed is:

1. A low noise block (LNB) having an antenna feed, a waveguide coupled to the antenna feed, the waveguide having a rear wall, a housing coupled to the waveguide and arranged substantially perpendicular to the waveguide, the waveguide rear wall comprising a part of the housing, the waveguide rear wall having at least one aperture therein for receiving a non-linear probe when coupled to a printed circuit board, the at least one aperture being dimensioned to allow the non-linear probe coupled to a printed circuit board to pass through the waveguide rear wall and into the waveguide such that the non-linear probe is oriented in the waveguide for reception of electromagnetic radiation passing therealong, said at least one aperture having dimensions being proportioned to minimise the leakage of microwave radiation passing through the aperture other than by the non-linear probe, the printed circuit board being insertable and removable with respect to the LNB housing without decoupling the printed circuit board from the non-linear probe.

2. A low noise block as claimed in claim 1 wherein said at least one aperture comprises two apertures disposed in the rear wall of the waveguide.

3. A low noise block as claimed in claim 2 wherein the two apertures are arranged on either side of a waveguide septum for receiving a respective probe on either side of the septum.

4. A low noise block as claimed in claim 3 wherein the two apertures are elongate.

5. A low noise block as claimed in claim 3 wherein the two apertures are keyhole-shaped and have ends which converge towards the septum of the waveguide.

6. A low noise block as claimed in claim 3 wherein the two apertures are rectangular, oval or circular.

7. A low noise block as claimed in claim 2 wherein the two apertures are rectangular, oval or circular.

8. A low noise block as claimed in claim 2 wherein the two apertures are elongate.

9. A low noise block as claimed in claim 2 wherein two the apertures are keyhole-shaped and have ends which converge towards each other and towards a septum of the waveguide.

10. A low noise block comprising an antenna feed, a waveguide coupled to the antenna, said waveguide having a rear waveguide wall, a housing coupled to the waveguide, wherein the rear waveguide wall comprises part of the housing, and the housing being oriented substantially perpendicular to the waveguide, a printed circuit board adapted to be secured to the housing, the printed circuit board carrying two non-linear probes for insertion into the waveguide, said rear waveguide wall having two apertures disposed therein for respectively allowing said non-linear probes when coupled to the printed circuit board to pass through the waveguide rear wall and into the waveguide, said apertures having dimensions being proportioned to receive said non-linear probes without the probes being removed or separated from the printed circuit board for installation of the non-linear probes within the waveguide and for removal of the non-linear probes from the waveguide.

* * * * *